US011664209B2

(12) United States Patent
Gill et al.

(10) Patent No.: US 11,664,209 B2
(45) Date of Patent: May 30, 2023

(54) MULTIPOLE DEVICE AND MANUFACTURING METHOD

(71) Applicant: SHIMADZU CORPORATION, Kyoto (JP)

(72) Inventors: Matthew Gill, Manchester (GB); Stephen Bloomfield, Manchester (GB); Richard Witter, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/516,790

(22) Filed: Nov. 2, 2021

(65) Prior Publication Data

US 2022/0059335 A1 Feb. 24, 2022

Related U.S. Application Data

(63) Continuation of application No. 16/762,253, filed as application No. PCT/EP2018/083832 on Dec. 6, 2018, now Pat. No. 11,205,567.

(30) Foreign Application Priority Data

Dec. 14, 2017 (GB) ..... 1720884

(51) Int. Cl.
*H01J 49/06* (2006.01)
*H01J 49/42* (2006.01)

(52) U.S. Cl.
CPC ..... *H01J 49/068* (2013.01); *H01J 49/063* (2013.01); *H01J 49/4215* (2013.01); *H01J 49/4225* (2013.01)

(58) Field of Classification Search
CPC .... H01J 49/063; H01J 49/068; H01J 49/4215; H01J 49/4225
See application file for complete search history.

(56) References Cited

U.S. PATENT DOCUMENTS 4,032,782 A 6/1977 Smith et al.
4,870,283 A 9/1989 Taya
(Continued)

FOREIGN PATENT DOCUMENTS

GB 2484898 A 5/2012
JP 59-87743 A 5/1984
(Continued)

OTHER PUBLICATIONS

International Search Report of PCT/EP2018/083832 dated Mar. 26, 2019 [PCT/ISA/210].
(Continued)

*Primary Examiner* — David E Smith
(74) *Attorney, Agent, or Firm* — Sughrue Mion, PLLC

(57) ABSTRACT

A method of manufacturing a multipole device includes the steps of: (a) forming an intermediate device by assembling a plurality of components including a plurality of precursor multipole electrodes, wherein the plurality of precursor multipole electrodes in the assembled device extend along and are distributed around a central axis; (b) forming a multipole device from the intermediate device by machining the precursor multipole electrodes within the intermediate device to provide a plurality of multipole electrodes having a predetermined spatial relationship; wherein a first component of the multipole device that includes a multipole electrode is attached non-permanently to a second component of the multipole device, the first component including a first alignment formation, and the second component including a second alignment portion configured to engage with the first alignment formation on the first component so as to facilitate alignment of the first component and the second component when the first component and the second component are attached, thereby allowing the first component to be detached from and then reattached to the second
(Continued)

component while retaining the predetermined spatial relationship between the plurality of multipole electrodes.

15 Claims, 10 Drawing Sheets

(56) References Cited

U.S. PATENT DOCUMENTS 4,949,047 A 8/1990 Hayward et al.
5,373,157 A * 12/1994 Hiroki ..... H01J 49/4215 250/281
5,384,461 A * 1/1995 Jullien ..... H01J 3/18 250/292
5,559,327 A 9/1996 Steiner
6,617,578 B1 * 9/2003 Tong ..... H01J 49/063 250/292
7,501,623 B2 * 3/2009 Tong ..... H01J 49/423 250/292
2003/0178564 A1 * 9/2003 Kernan ..... H01J 49/4255 250/292
2007/0114391 A1 5/2007 Mordehai et al.
2011/0101220 A1 5/2011 Syms
2011/0240849 A1 * 10/2011 Wright ..... H01J 49/0013 250/288
2014/0061457 A1 * 3/2014 Berdnikov ..... H01J 49/0095 250/281
2017/0287689 A1 * 10/2017 Gill ..... H01J 49/063

FOREIGN PATENT DOCUMENTS

WO 2010/026424 A1 3/2010
WO 2010/026426 A2 3/2010

OTHER PUBLICATIONS

Written Opinion of PCT/EP2018/083832 dated Mar. 26, 2019 [PCT/ISA/237].

* cited by examiner

MULTIPOLE DEVICE AND MANUFACTURING METHOD

CROSS REFERENCE TO RELATED APPLICATIONS

This application is a Continuation of U.S. application Ser. No. 16/762,253, filed May 7, 2020, which is a National Stage of International Application No. PCT/EP2018/083832, filed Dec. 6, 2018, claiming priority to British Patent Application No. 1720884.4, filed Dec. 14, 2017.

TECHNICAL FIELD OF THE INVENTION

The present invention relates to a method of manufacturing a multipole device, and also to multipole devices manufactured according to such a method.

BACKGROUND TO THE INVENTION

Quadrupole mass filters and linear ion traps are well known analytical devices used for measurement of the mass-to-charge ratio of charged particles. Such mass spectrometry techniques are well known and commercially available A typical mass filter, analytical quadrupole or linear ion trap geometry is composed of four electrodes disposed about a common axis. These electrodes can have numerous forms, generally round-section rods, rods with hyperbolic faces, or flat plates. FIGS. 1A and 1B show a prior art quadrupole device, in perspective view and cross-section respectively. The device consists of four round-section electrically conducting rods 101 held within a pair of insulating collars 103. The longitudinal axis of the device is defined as the z axis, with the pairs of electrodes aligned with the x- and y-axes called the x- and y electrodes.

Frequently, such devices will have further quadrupole rod structures 205 placed before and/or after the device, for the purposes of ion introduction, or trapping etc. Such a geometry is shown in FIG. 2A. Such structures may be described as segmented quadrupoles or ion traps. Another term for such pre- or post-rods is Brubaker rods. Other suitable structures utilise plates with holes 207, as shown in FIG. 2B.

In operation, such devices may be operated by application of radiofrequency (RF) waveforms to the rods to generate a trapping waveform suitable to confine charged particles radially within the device. Normally, a direct current (DC) voltage is applied to the structures placed at the ends of the device, either to allow transfer of ions through the device (such as when operating as a mass filter), or to confine ions axially (such as when operating as an ion trap). Other known systems trap ions by application of RF waveforms to the end plates. There is a great deal of study in the area of mass filter and linear ion trap operation, and suitable geometries may be chosen according to the application. For example, the rod structures may incorporate slots to allow ejection of ions, or may have additional rods or structures between the main RF electrodes for alternative purposes such as urging of ions along the device. The electrodes of the device may be electrically connected in numerous ways. One common example would be to electrically connect the electrodes disposed in one axis together, and electrically connect the electrodes disposed in the other axis together. RF waveforms may then be applied in antiphase to these pairs of electrodes to generate a confining field. The RF could take many forms, including sinusoidal, square, rectangular, triangular, sawtooth etc. A further method would electrically connect the electrode disposed in one axis, but maintain the electrodes disposed in the other axis as electrically separate from one-another. In this way, different radiofrequency waveforms may be applied to this "separated pair" of electrodes. Such a method may be used, for example, to apply a dipole excitation waveform to excite charged particles trapped within the device.

In general, quadrupole mass filters and quadrupole linear ion traps employ a similar electrode structure, with differences in design appropriate to the method of operation of the devices. The theory used to describe ion motion within both type of device is well known and similar theory applies equally to mass filters or linear ion traps. Such theory is described for example in Practical Aspects of Ion Trap Mass Spectrometry, Volume IV, Raymond E March and John F J Todd, CRC Press, 2010, pages 148-168.

In all cases, it is well known that such devices, when operated as analytical devices for transmitting, filtering or measuring the mass-to-charge ratio of charged particles, must be manufactured very accurately. By this, it is meant that the location and form of the electrode surfaces should be to within a tightly prescribed tolerance of the ideal geometry, generally to within ±5 μm or frequently less (within ±2 μm or even ±1 μm is not uncommon).

To achieve such high accuracies, high precision components are frequently employed. A typical manufacturing process for either a linear ion trap or a quadrupole mass filter might employ precision ground & lapped ceramic insulators and precision ground & lapped metal rods. These components are expensive to produce due to the extremely tight tolerances required in order to ensure that "tolerance stack-up" does not prevent the assembled device from achieving the required tolerances. The components of such devices are frequently aligned to one-another using a jigging process, although there are many techniques suitable for assembling such structures. The high precision manufacture required to produce the component parts and the skilled assembly techniques required mean that these devices are costly to manufacture.

An alternative approach consists of a "build and cut" method, whereby electrode blanks are pre-assembled into a supporting insulating structure and then machined in situ to obtain the final electrode surfaces. By this method, the component parts may be of comparatively lower precision than by the traditional manufacturing technique, with the precision of the assembly obtained from the fact that the electrode surfaces are all machined at the same time on the same machine. Several machining techniques are suitable for this method, and United States patent applications U.S. Pat. No. 5,384,461A and US2007114391A1 describe such a manufacturing method. The disadvantage of such a technique is that the assembly can never be disassembled once cut. This can be a problem if further processes are required in manufacture, such as cleaning, electrode plating etc. Furthermore, in such methods, disassembly would lead to changes in the geometry of the quadrupole as the systems are usually mechanically over-constrained: each of the six degrees of freedom are constrained more than once, leading to uncertainty over where the parts will be located after reassembly.

To obtain the highest accuracy from a machining method, it may be prudent to perform machining of all critical electrode surfaces in a single operation. In this way, tolerance stack-up is avoided, and the relative precision of all surfaces is as tightly controlled as possible. Further, as the part is not removed from the machine tool, there are no alignment errors during manufacture.

It may also be desirable to be able to disassemble the part after the machining has taken place. In this way, before the final assembly, steps such as cleaning and gold plating can be performed. However, as discussed above, when using the manufacturing methods of the prior art, reassembly is not possible without a change in the geometry. This is clearly undesirable given the high precision required for analytical quadrupole devices.

BACKGROUND ART

US2007114391A1 describes a method of manufacturing a segmented linear ion trap device. The assembly is made by mounting conductive (metal) blanks to a series of insulating (ceramic) ring supports, and then using wire-EDM to cut the workpiece into four quadrupole rods and segments. US2007114391A1, GB2484898A and WO2010026424A 1 also describe manufacture of a quadrupole or ion trap device by bonding conductive electrode material to insulating material and then forming the final electrode profile by wire Electric Discharge Machining (EDM).

SUMMARY OF THE INVENTION

At its most general, the present invention may provide a method of manufacturing a multipole device including electrode elements which can be assembled together repeatably, with little to no change in the accuracy of the assembled geometry, thus allowing machining of the assembled parts before disassembly. Specifically, in order to achieve this, the present invention may provide a method of manufacturing a multipole device, the method including the steps of:

(a) forming an intermediate device by assembling a plurality of components including a plurality of precursor multipole electrodes, wherein the plurality of precursor multipole electrodes in the assembled device extend along and are distributed around a central axis;

(b) forming a multipole device from the intermediate device by machining the precursor multipole electrodes within the intermediate device to provide a plurality of multipole electrodes having a predetermined spatial relationship;

wherein a first component of the multipole device that includes a multipole electrode is attached non-permanently to a second component of the multipole device, the first component including a first alignment formation, and the second component including a second alignment portion configured to engage with the first alignment formation on the first component so as to facilitate alignment of the first component and the second component when the first component and the second component are attached, thereby allowing the first component to be detached from and then reattached to the second component while retaining the predetermined spatial relationship between the plurality of multipole electrodes.

The presence of alignment formations on the first and second components helps the multipole device to be reassembled into an arrangement having the same spatial relationship as when it is machined, i.e. such that they can be repeatably repositioned to high accuracy. In this way, the method of the present invention may achieve the benefits of both the high precision grinding method, and the bond-and-cut method, since the components may be assembled (i.e. finally assembled) after machining, but are all machined in the same operation, e.g. in order to avoid tolerance stack-up and so to achieve high accuracy. This is in contrast to prior methods, in which the component parts are bonded or fixed (i.e. glued) together before machining.

The method also has the advantage that the plurality of precursor multipole electrodes need not be formed to high accuracy, since the machining process defines the accuracy of the plurality of multipole electrodes to with respect to one another.

Optional features of the invention will now be set out. These are applicable singly or in any combination with any aspect of the invention.

In preferred embodiments, the precursor multipole electrodes are machined using wire electrical discharge machining (wire-EDM, also called "wire erosion"), which is a highly accurate (typically ±2.5 μm) machining process, which leads to excellent electrode-to-electrode accuracy. It is especially suitable because it does not apply mechanical forces to the multipole device during machining, and is therefore unlikely to disturb the position of the plurality of precursor multipole electrodes.

As discussed earlier, one key advantage of this approach is that intermediate processing steps may be performed after the precursor multipole electrodes have been machined, but before reassembly. Specifically, the method may further include the steps of:

(c) disassembling the plurality of multipole electrodes;

(d) performing at least one processing step on the plurality of multipole electrodes; and (e) reassembling the plurality of multipole electrodes to reform the multipole device, in which the plurality of multipole electrodes have the same predetermined spatial relationship.

Step (d), may include cleaning of the plurality of multipole electrodes. Cleaning, preferably using ultrasonic agitation, is likely to be beneficial to remove residue and particulate material from the machining process, as well as removing organic contaminants such as machining coolants.

Step (d) may include further polishing or electropolishing of the critical surfaces, i.e. the surfaces of the plurality of multipole electrodes. If electropolishing process are to be used, an even layer of material is preferably removed from the electrode surfaces, and the thickness of this layer may be taken in to account when performing the machining step (both for the surfaces of the plurality of multipole electrodes and the surfaces of the alignment formation, if they are not masked during the electropolishing step).

Step (d) may include plating of the plurality of multipole electrodes, for example to reduce surface contamination or to ensure equal electric potentials on the electrode surfaces. Such plating may be by electroplating, sputtering, evaporation, or other known plating techniques. Plating materials may include gold, silver, platinum or other metals. Optionally, other plating or coating processes could be used. Plating of the electrodes would be impossible or difficult on the assembled quadrupole because the plating process may coat the insulating parts, reducing or removing the efficiency of electrical isolation. It may be possible to mask the insulators, but this additional process is costly and difficult to achieve accurately.

The method according to the first aspect of the present invention requires that the plurality of multipole electrodes may be reassembled to have the same predetermined spatial relationship as during the machining step. Specifically, it is preferred that the position of any point on a surface of the second component is substantially the same before and after detachment and reattachment of the first component and second component, relative to a coordinate system which is fixed with respect to the first component. Here, substantially the same may mean that the deviation is no more than 10 μm, preferably no more than 5 μm, more preferably no more than 2 μm, more preferably no more than 1 μm, more preferably no more than 0.5 μm, and most preferably no more than 0.1 μm. By "deviation", we refer to the change in position of the second component relative to the first component (in the coordinate system fixed with respect of the first component) before and after detachment and reattachment.

The position of the components may be established by the use of a Coordinate

Measuring Machine (CMM), which routinely have measurement errors of less than around +/−2.0+3 L/1000 μm, although high accuracy CM machines are available with measurement errors of less than around +/−0.3+L/1000 μm. Measurement strategies involving measurement of a high number of points can allow the locational accuracy of a component to be established to better than these measurement errors.

In order to achieve this level of precision, the first alignment formation and second alignment formation preferably form parts of a kinematic alignment formation. Specifically, in this application, kinematic alignment formations may be those which constrain the motion of the first component relative to the second component once in each degree of freedom. Here, "once" should be understood to mean "exactly once". If there is more than one constraint in each degree of freedom (x, y, z, a, /3, y), the system may be viewed as over-constrained, which may lead to uncertainty in the spatial relationship of the plurality of multipole electrodes after reattachment of the first component and second component. In three dimensions, there are six degrees of freedom. These may be considered to correspond to translation along, and rotation around, each of the x-, y- and z-axes, in Cartesian coordinates, although there are believed to be still six degrees of freedom in whichever coordinate system is used. Kinematic alignment of the component parts of the multipole device allows very high reproducibility of alignment.

In some embodiments, the first alignment formation may be configured to engage directly with the second alignment formation. For example, the first alignment formation may directly contact the second alignment formation.

In such embodiments, in order to provide kinematic alignment as discussed in the previous paragraph, the first alignment formation is preferably arranged to contact the second alignment formation in only six locations, when the first component is attached to the second component. This is believed to effectively mean that there is only one solution to the equation governing the spatial relationship between the first component and the second component, ensuring that when those components are detached and reattached, they necessarily return to the same configuration.

In embodiments in which the first alignment portion engages directly with, i.e.

contacts directly, the second alignment formation, it may include at least one curved surface, the surface preferably being curved about two non-parallel axes. The second alignment formation may include a flat surface, or a curved surface. In such embodiments, is preferred that the first alignment formation is arranged to contact the second alignment formation at only six points, as opposed for example to plane-plane contact (which would likely represent an over-constraint).

The first alignment formation may include a notch. It is preferred that the notch have two surfaces, and therefore a substantially triangular cross-section. Preferably the surfaces are flat. The notch is preferably in the form of a V-groove, in which it is preferred that the walls intersect at 45°. An alternative to the V-groove is use of a pair of cylindrical surfaces (spherical or spheroidal surfaces may also be used) arrange to form a channel which, in operation, provides the same function as the V-groove or notch. The channel can have either convex or concave surfaces. In such embodiments it is preferred that the second alignment formation include a spherical or spheroidal structure. In embodiments in which the channel includes a concave cylindrical (or spherical, or spheroidal) surface, it is preferred that in locations where the second alignment formation is to contact the concave surface, that the second alignment portion has a smaller radius of curvature than the channel at that point. In this way when the first alignment formation engages (directly) with the second alignment formation, there are two points of contact only. In order to obtain six points of contact, the first alignment formation may include three notches, and the second alignment formation may contain three spherical or spheroidal structures, wherein each of the notches is arranged to engage with a respective one of the spherical or spheroidal structures when the first component and the second component are attached. In other embodiments, the first alignment formation may include one notch and two spherical or spheroidal structures, and the second alignment formation may include two notches and one spherical or spheroidal structure.

In other embodiments, the first alignment formation may be configured to engage indirectly with the second alignment formation, via one or more intermediary components. In other words, when the first component is attached to the second component, the first alignment formation does not contact the second alignment formation directly. Rather, both the first alignment formation and the second alignment formation are in contact with the intermediary component. Similarly to the "direct" embodiments, it is preferred that when the first component and the second component are attached, each of the first alignment formation and the second alignment formation contact the one or more intermediary components in only six locations.

The first alignment portion and/or the second alignment portion may include a notch. It is preferred that the notch have two surfaces which are preferably flat, and therefore a substantially triangular cross-section. The notch is preferably in the form of a V-groove, in which it is preferred that the walls intersect at approximately 45°. An alternative to the V-groove is use of a pair of cylindrical surfaces (spherical or spheroidal surfaces may also be used) arranged to form a channel which, in operation, provides the same function as the V-groove or notch. The channel can have either convex or concave surfaces. In such embodiments it is preferred that the one or more intermediary components include one or more spherical or spheroidal structures. In embodiments in which the channel includes a concave cylindrical (or spherical, or spheroidal) surface, it is preferred that in locations where the second alignment formation is to contact the concave surface, that the second alignment portion has a smaller radius of curvature than the channel at that point. In preferred embodiments, each of the first alignment formation and the second alignment formation include three notches, and the intermediary components are in the form of three spherical or spheroidal structures. In such embodiments, each notch of each of the first alignment formation and the second alignment formation may be configured to contact each of the three spherical or spheroidal structures in exactly two locations. Thus, each of the first alignment formation and the second alignment formation is in contact with the intermediary components in only six locations, as is required for kinematic alignment.

It is preferred that the intermediary components are in the form of spherical or spheroidal structures (herein, also "balls"), preferably made from electrically insulating material, such as alumina, ruby, sapphire or silicon nitride. The material may, alternatively, be chosen to suit other requirements such as volume resistivity, dielectric strength or thermal expansion coefficient. It is preferable that the insulating balls are made from a material which is as hard as, or harder than alumina. This is advantageous since it is possible to use off-the-shelf insulating balls, which can be purchased cheaply and at a high standard. This is in contrast to the ceramic rings (see e.g. FIGS. 1A and 1B), which must be accurately machined, and are therefore costly.

When the multipole device is disassembled and subsequently reassembled, the insulating balls used in the reassembly step may be either the same or different balls. If different balls are used, care should be taken to ensure that the new balls come from the same manufacturing lot, and have the same dimensional characteristics. If so, the device can be reassembled with little to no loss of accuracy of alignment. In some embodiments, the multipole device may include one or more of a spring, a spring washer, a crinkle washer, or another means of applying an approximately constant force to the fastener. This means may be used to allow for changes in the geometry of the assembly or fastener due to thermal expansion, ensuring that pre-load force is maintained at constant magnitude.

As an alternative to the notch and ball formations, each or either of the first alignment formation, the second alignment formation and the one or more intermediary components may include a flat surface or, a conical surface. Other forms of the alignment formations are described in more detail later in the application, with reference to FIG. 6.

In order to reduce the area of contact when the two alignment formations are in contact with each other and to reduce the effect of material deformation, it is preferred that the plurality of multipole electrodes are made from a hard, electrically conductive electrode, such as ICONEL 718, stainless steel, molybdenum, Hastelloy, and the like. The material chosen for the electrode structure may be chosen to suit other requirements, such as optimal thermal expansion coefficient or electrical conductivity (frequently denoted a). In preferred embodiments, the material used for the multipole electrodes is as hard as, or harder than stainless steel. Suitable material hardnesses may be hardnesses greater than e.g. 140 on the Brinell hardness scale. Suitable thermal expansion coefficients might be as low as possible in some applications (such as less than 10 μm/m·K−1, less than 5 $\mu m/m \cdot K^{-1}$ or less than 2 $\mu m/m \cdot K^{-1}$). Suitable electrical conductivity might be greater than $1.2 \times 10^6$ Sim.

In order to improve the accuracy of the kinematic alignment, the surfaces of the first alignment formation and the second alignment formation are preferably finished to a high standard, preferably having Ra 0.4.

The increased precision provided by this method is particularly effective for the manufacture of multipole devices for use in linear ion traps or mass filters. In preferred embodiments, the multipole device is a quadrupole device, but it could also be a hexapole or octopole device. More specifically, the method of the present invention is particularly effective for the manufacture of quadrupole ion guides, segmented quadrupole ion guides, quadrupole mass filters, segmented quadrupole mass filters, linear ion traps or segmented linear ion traps.

In preferred embodiments of the present invention, the plurality of components may include a main body including at least two integrally formed poles, wherein two or more other poles are configured to be attached to the main body. In particularly preferred embodiments, the two or more other poles may be configured to be situated within the main body. The poles may have cylindrical surfaces, flat surfaces, hyperbolic surfaces, or surfaces with any other geometric profile. It should be noted that in this application, when referring to the multipole electrodes extending "along" a central axis, this does not require the electrodes to be extending parallel to the axis, and in fact they may be tilted or twisted with respect to said axis. Similarly, when the multipole electrodes are "distributed around" a central axis, this does not mean that they are necessarily distributed angularly or spatially equally about the axis.

The present invention is not only directed to the manufacturing method of the multipole device. Accordingly, a second aspect of the present invention provides a multipole device, including:

a plurality of components including a plurality of multipole electrodes extending along and distributed around a central axis, the plurality of multipole electrodes having a predetermined spatial relationship;

wherein a first component of the multipole device that includes a multipole electrode is attached non-permanently to a second component of the multipole device, the first component including a first alignment formation, and the second component including a second alignment portion configured to engage with the first alignment formation on the first component so as to facilitate alignment of the first component and the second component when the first component and the second component are attached, thereby allowing the first component to be detached from and then reattached to the second component while retaining the predetermined spatial relationship between the plurality of multipole electrodes.

All of the optional features presented above with reference to the manufacturing method of the first aspect of the invention may also apply to the device of the second aspect of the invention, where they are compatible. A preferred embodiment of the second aspect of the invention provides a multipole device fabricated using the method of the first aspect of the invention.

Further optional features of the invention are set out below.

BRIEF DESCRIPTION OF THE DRAWINGS

Embodiments of the invention will now be described by way of example with reference to the accompanying drawings in which.

DETAILED DESCRIPTION OF THE DRAWINGS

FIGS. 3A to 3D illustrate an embodiment of the method of the present invention and the resulting product, in which the method is used to prepare a quadrupole device 300 having hyperbolic poles.

Figure 1A:
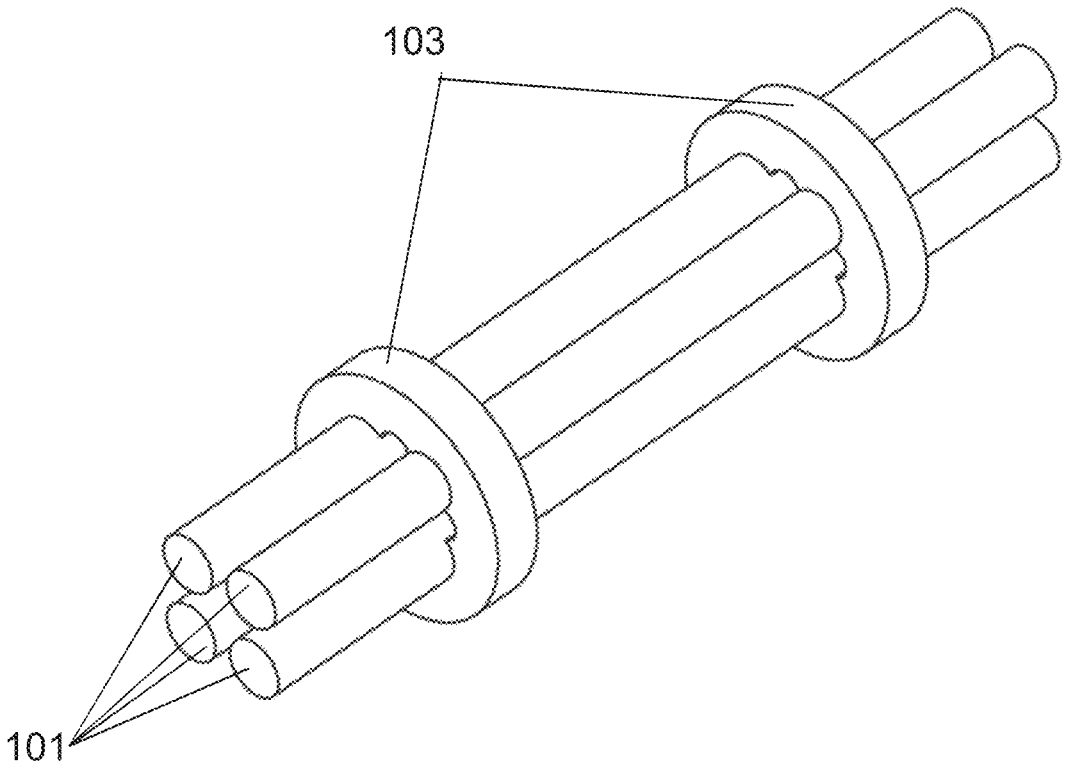
FIGS. 1A and 1B show a prior art quadrupole device.
Figure 1B:
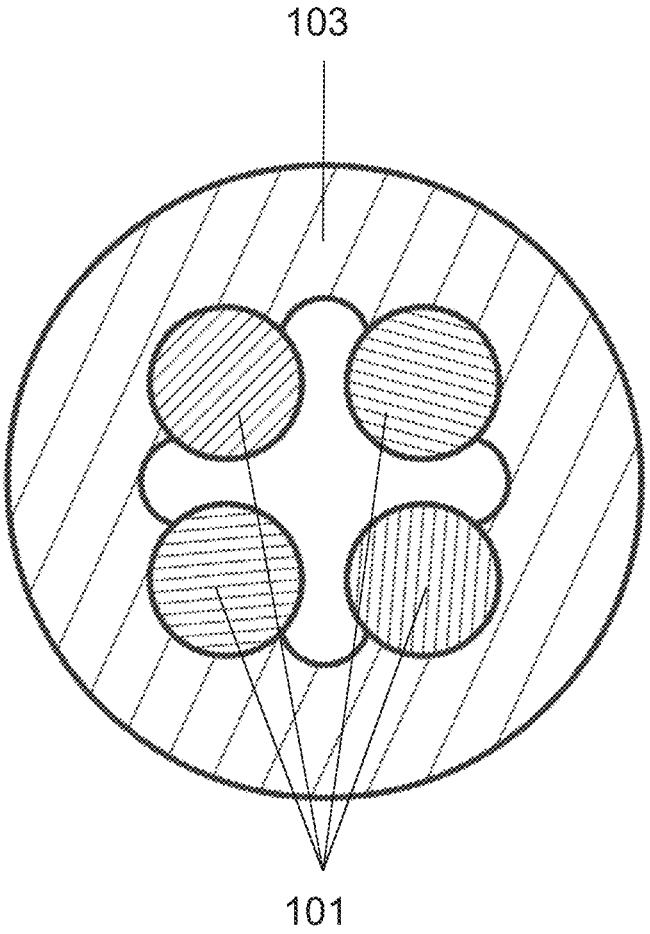
Figure 2A:
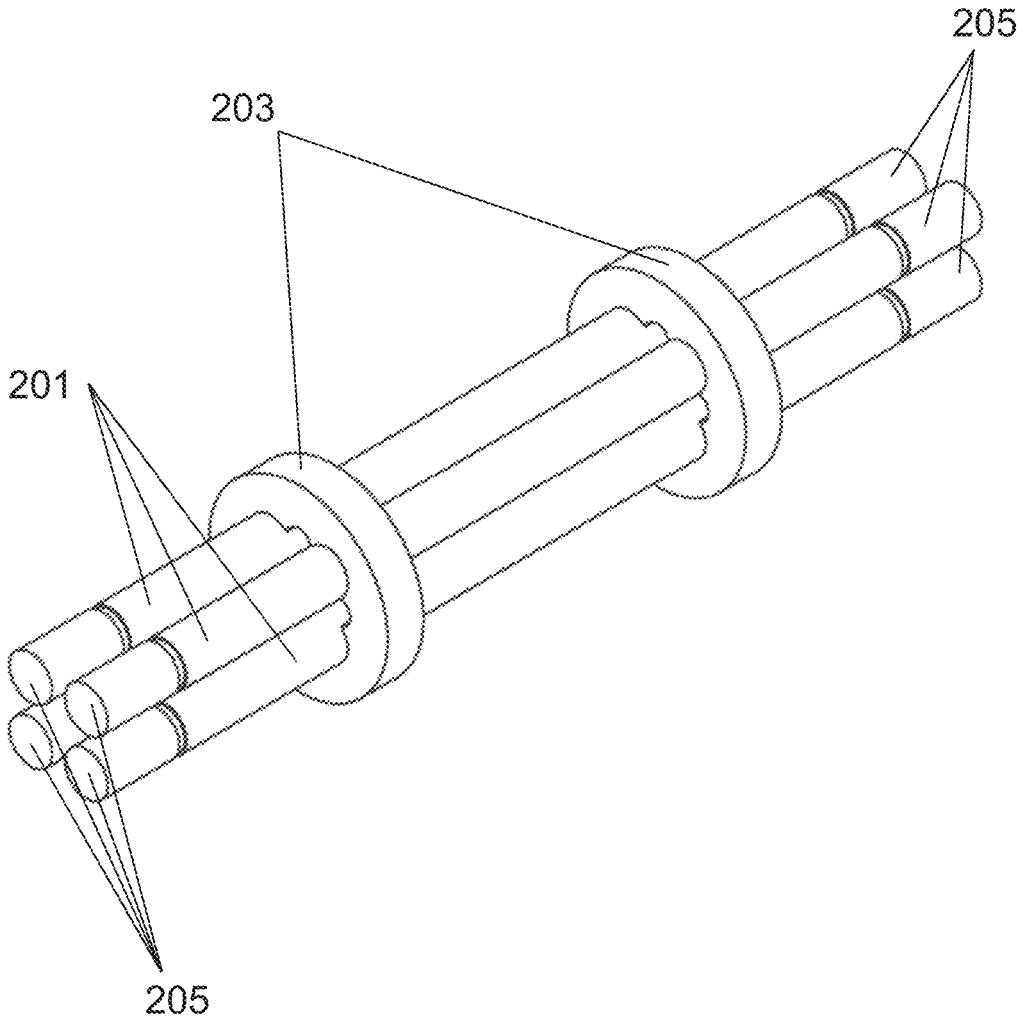
FIGS. 2A and 2B show prior art quadrupole devices in place in segmented ion traps.
Figure 2B:
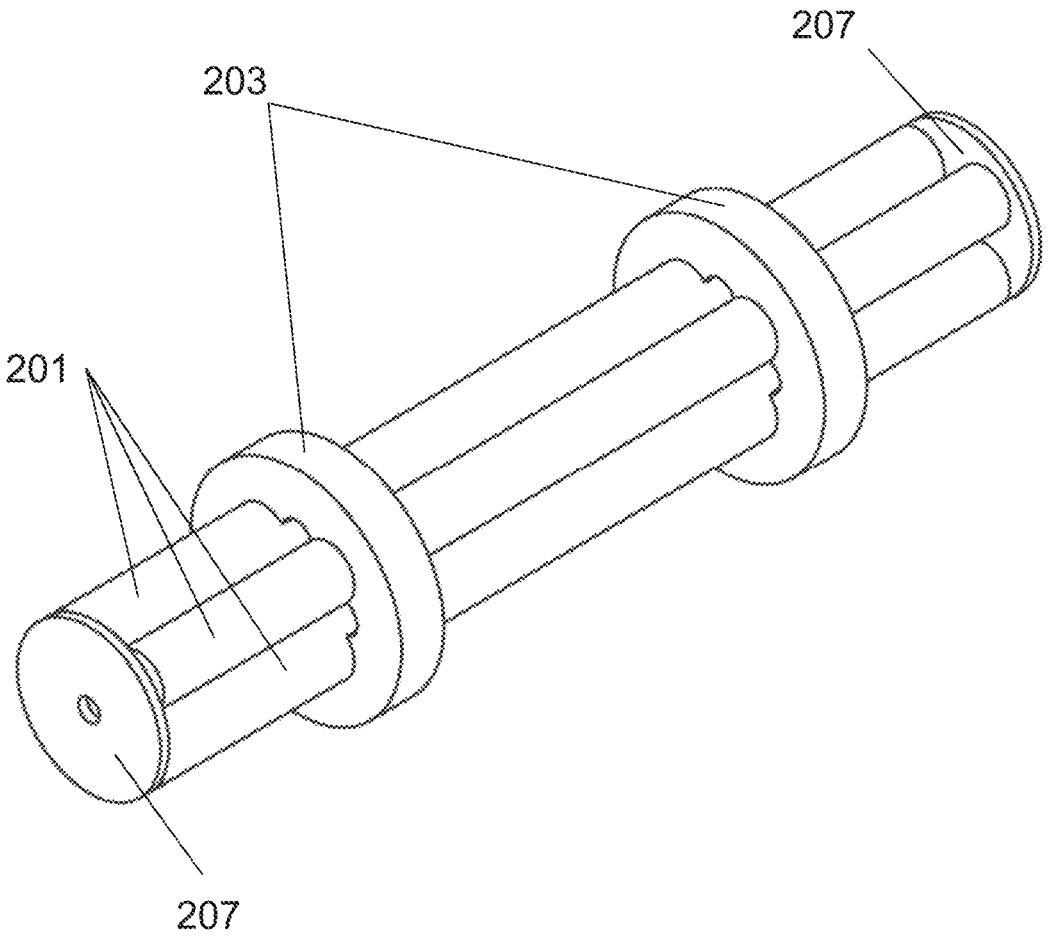
Figure 3A:
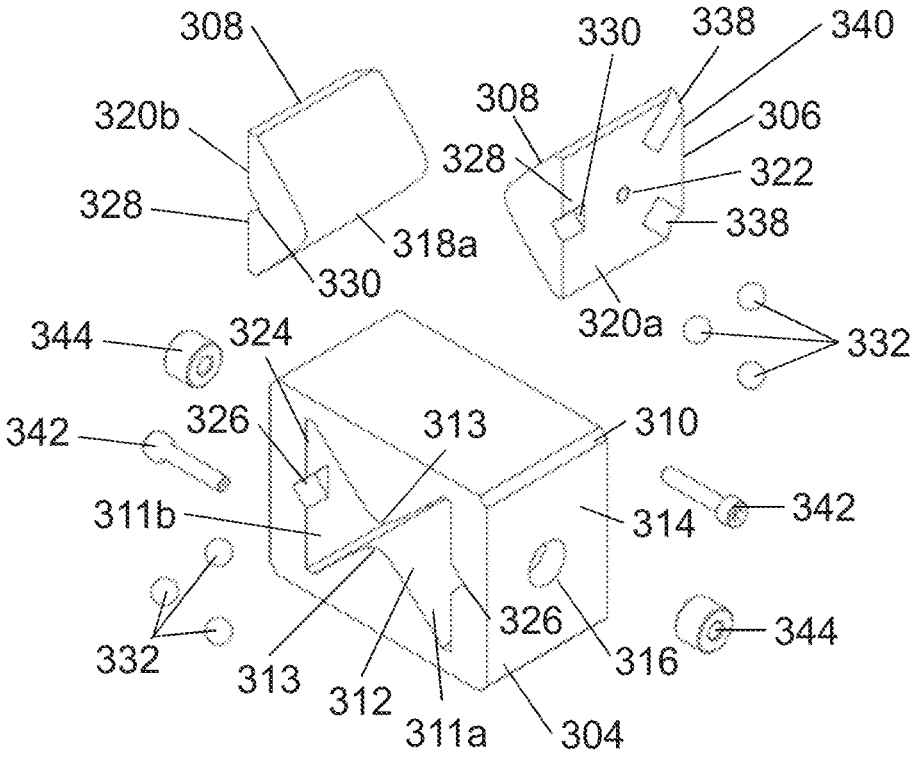
FIGS. 3A to 3D show the manufacturing process of the present invention, and the finished quadrupole device.

FIG. 3A shows three precursor electrode structures 304, 306, 308. Main body 304 is a largely cuboidal structure having bevelled edges 310. There is a channel 312 passing through the centre of the main body 304, the channel 312 having a bow-tie shaped cross section, with two lobes 311*a*, 311*b*, and running along the full length of the main body 304. The surfaces 313 where the top and bottom walls of channel 312 are at their closest are hyperbolic surfaces. These surfaces 313 form two of the four poles when the quadrupole device 300 is fully assembled. The side walls 314 of the main body 304 have a hole 316 extending therethrough, the hole 316 opening into the channel 312.

Electrodes 306, 308 are substantially triangular prismatic in shape, and are each shaped to fit in a respective lobe 311 of the channel 312. The inner surfaces 318*a*, 318*b* of electrodes 306, 308 are hyperbolic in shape, and when the quadrupole device 300 is assembled, form the remaining two poles along with surfaces 313. The flat surfaces 320*a*, 320*b* of electrodes 306, 308 include holes 322, which, when electrodes 306, 308 are in place inside channel 312, align with the holes 316 in the side walls 314 of the main body 304.

Each of the vertical edges 324 of the front opening of the channel 312 includes a V-shaped notch 326. The corresponding edges 328 on the electrodes 306, 308 include corresponding notches 330. The notches 326, 330 are located such that when the electrodes 306, 308 are fitted in place inside the channel 312, the notches 326, 330 are spatially adjacent.

Assembly of the device 300 will now be described. Electrodes 306, 308 are slotted through respective lobes 311*a*, 311*b* of the channel 312 until holes 316, 322 are aligned. Then, insulating balls 332 are placed into the spaces 334, 336 formed by the alignment of the notches 326 of the main body 304 and notches 330 of the electrodes 306, 308. When the insulating balls 332 are placed into said spaces 334, 336, each of the surfaces of each V-shaped notch 326, 330 contacts the respective insulating ball 332 once. Though not shown in the drawings, there are two additional notches 338 on the back edge 340 of the electrodes 306, 308, and corresponding notches in the back edge of the main body 304. These also line up when the electrodes 306, 308 are in place inside the channel 312 of the main body 304, to generate two additional spaces, into each of which another insulating ball 332 is placed. This ensures that the notches 326 on the main body 304 engage with the notches 330 of each of the electrodes 306, 308 in six locations, and kinematic alignment may be achieved between the main body 304 and each of the electrodes 306 and 308. Once the notches 326, 330 and insulating balls 332 are used to correctly align the main body 304 and electrodes 306, 308, a fastener 342 and washer/bush 344 may be used to secure the pieces in place, as shown in FIG. 3B.

Figure 3B:
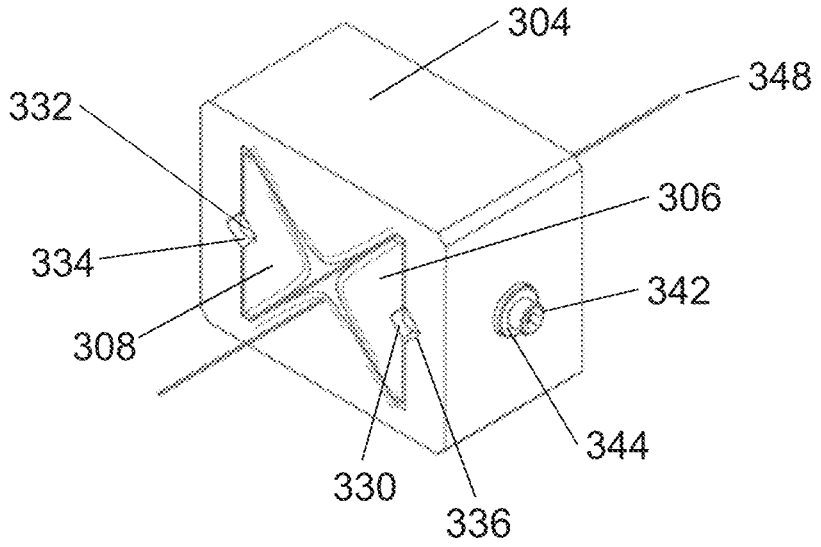

Once the pieces have been assembled into device 346, as shown in FIG. 3B, the surfaces of the electrodes 304, 306, 308 can be machined by wire-EDM, using wire 348. This highly accurate technique, which takes place while the pieces are assembled, ensures that the surfaces of the electrodes have exactly the required geometry. Thereafter, the pieces making up newly-machined device 346 can be disassembled for additional processing such as cleaning, polishing and electroplating. Then, by reassembling the electrodes 304, 306, 308 using the notches 326, 330 and insulating balls 332 as before, it is possible to arrange the pieces into substantially exactly the same geometry as they had immediately after machining, as shown in FIG. 38. This is possible due to the kinetic alignment of the pieces. Optionally, the component electrodes 306, 308 may be marked to simplify replacement in the same position within the electrode 304.

Figure 3C:
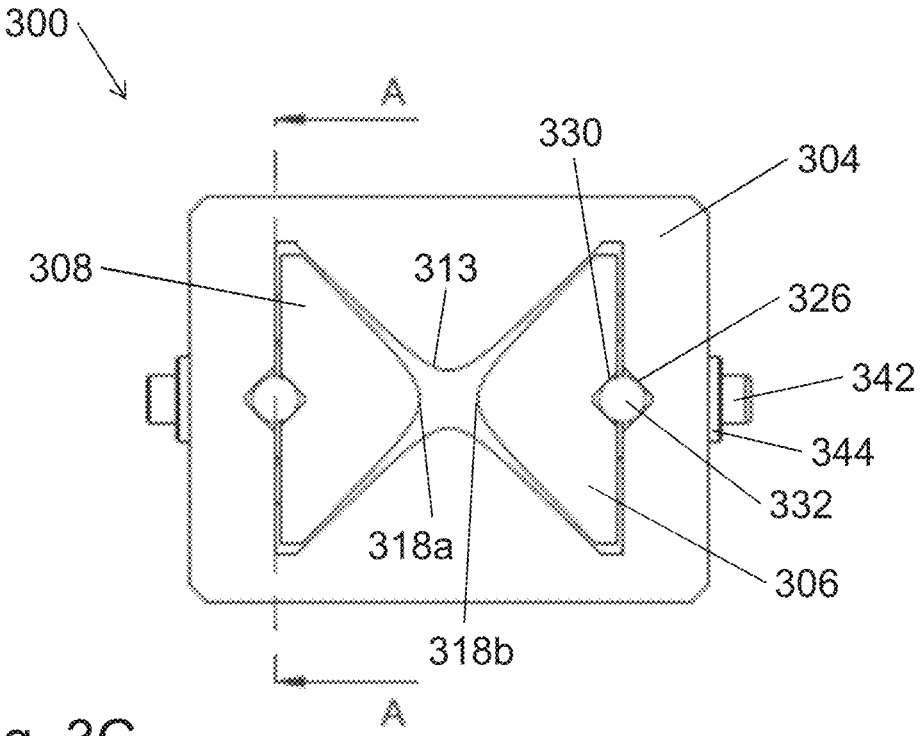
Figure 3D:
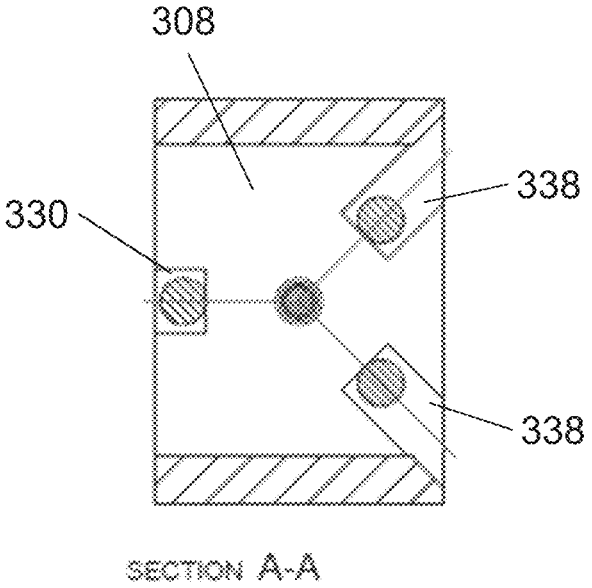

FIG. 3C shows a side view of the device 346 shown in FIG. 38, and FIG. 3D shows a cross section through line A-A of FIG. 3C, which shows all three notches 326 containing the insulating balls 332. FIG. 3D highlights the point that the centrelines of the V-shaped notches 326 should intersect at the coupling centroid C, where the fastener 342 is located. The stiffness of the assembly is then equal in all directions when the insulating balls 332 intersect the V-shaped notches 326 at 45°.

Figure 4A:
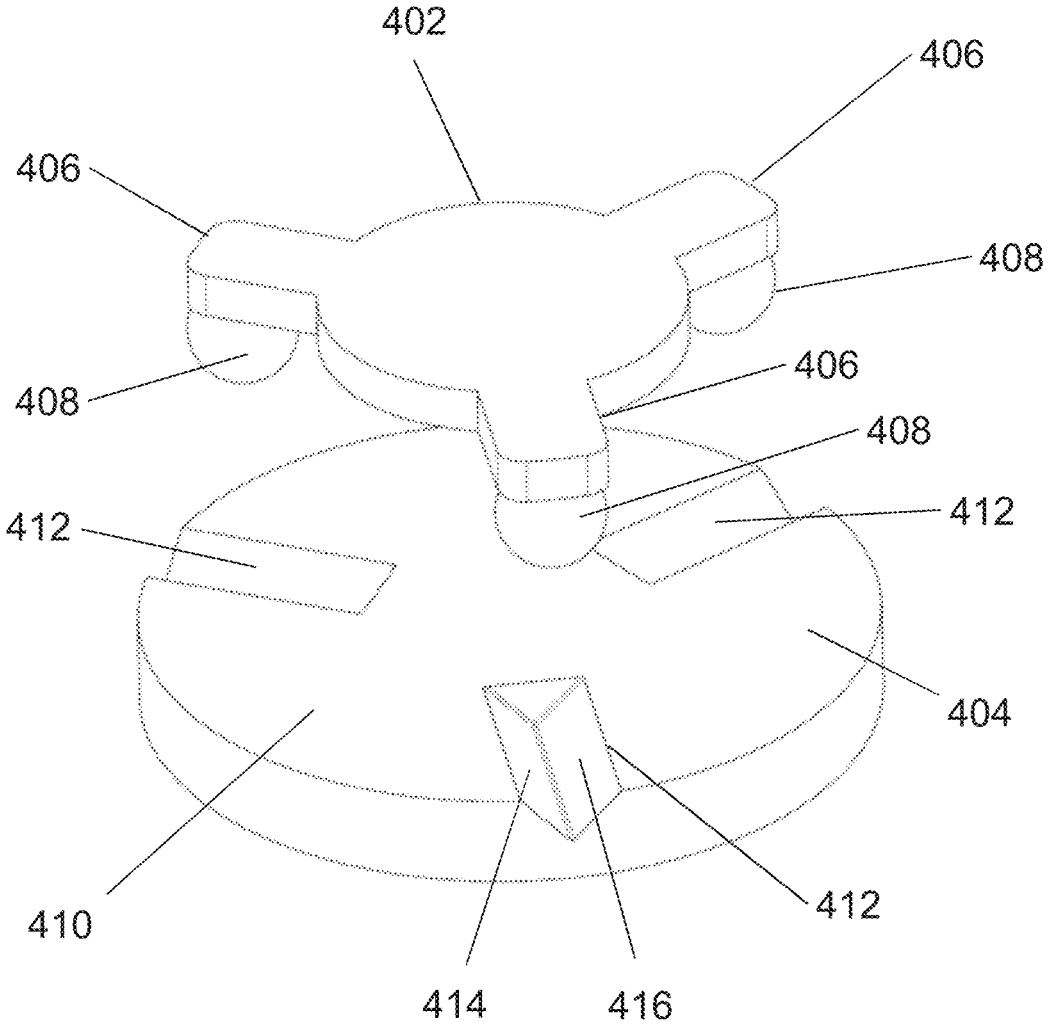
FIGS. 4A and 4B illustrate examples of kinematic alignment.
Figure 4B:
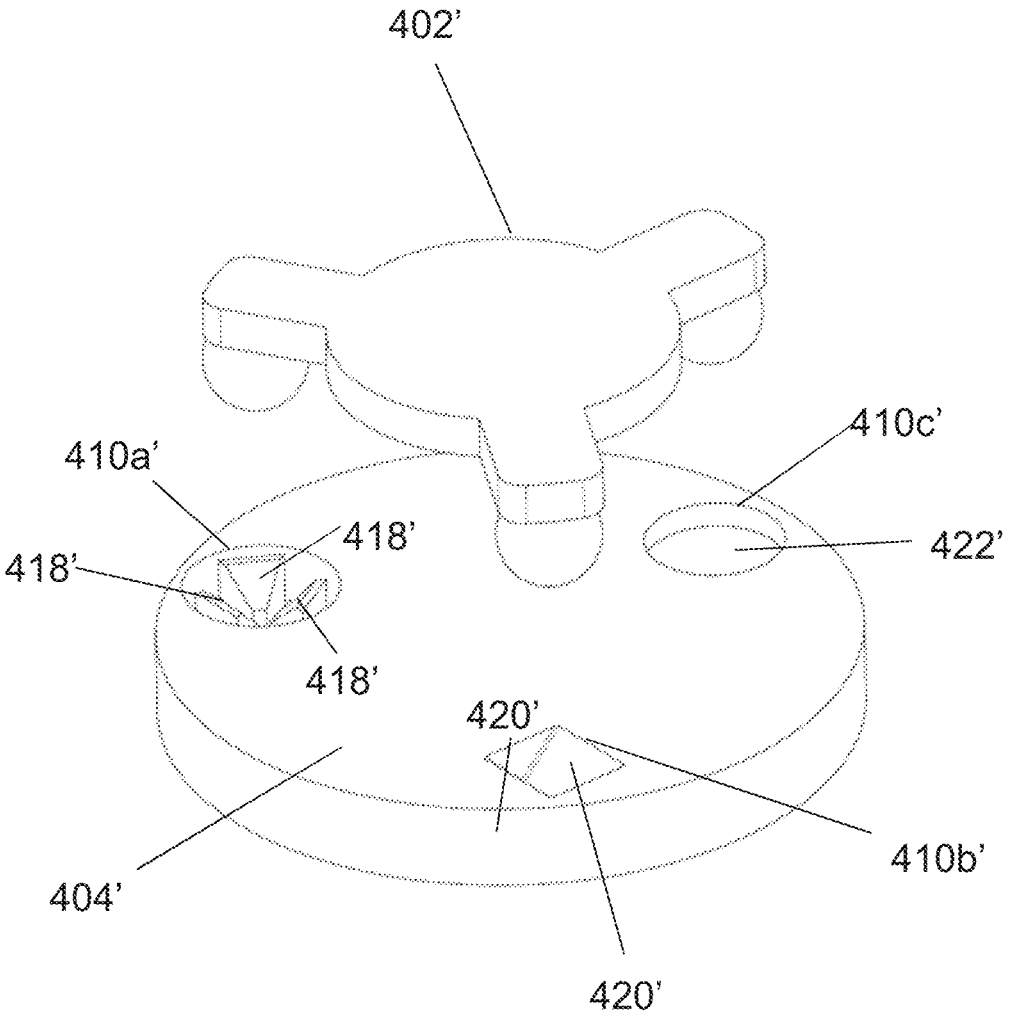
Figure 5A:
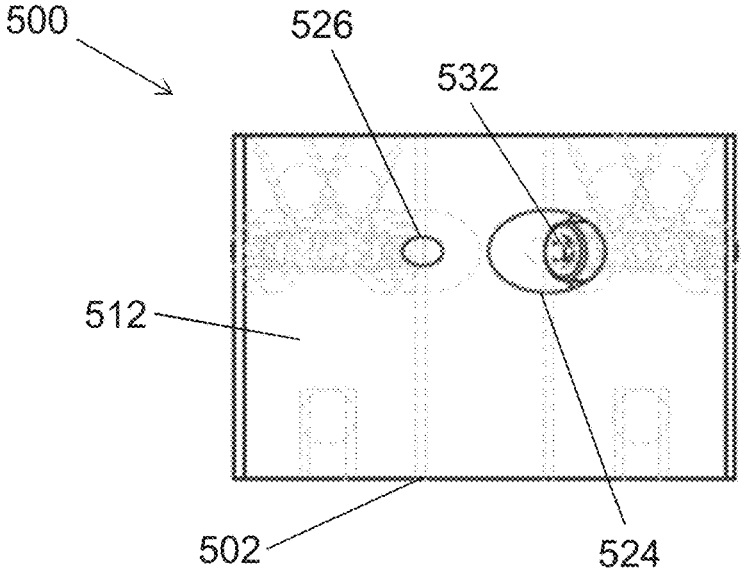
FIGS. 5A to 5D show an alternative example of a device which may be produced using the manufacturing method of the present invention.
Figure 5B:
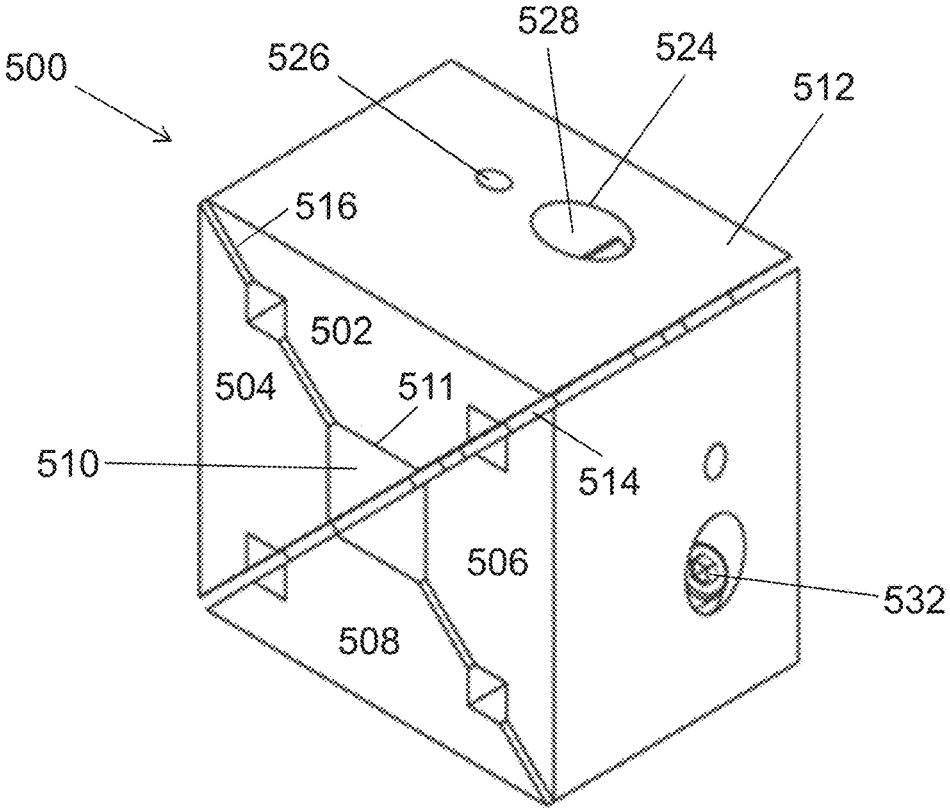
Figure 5C:
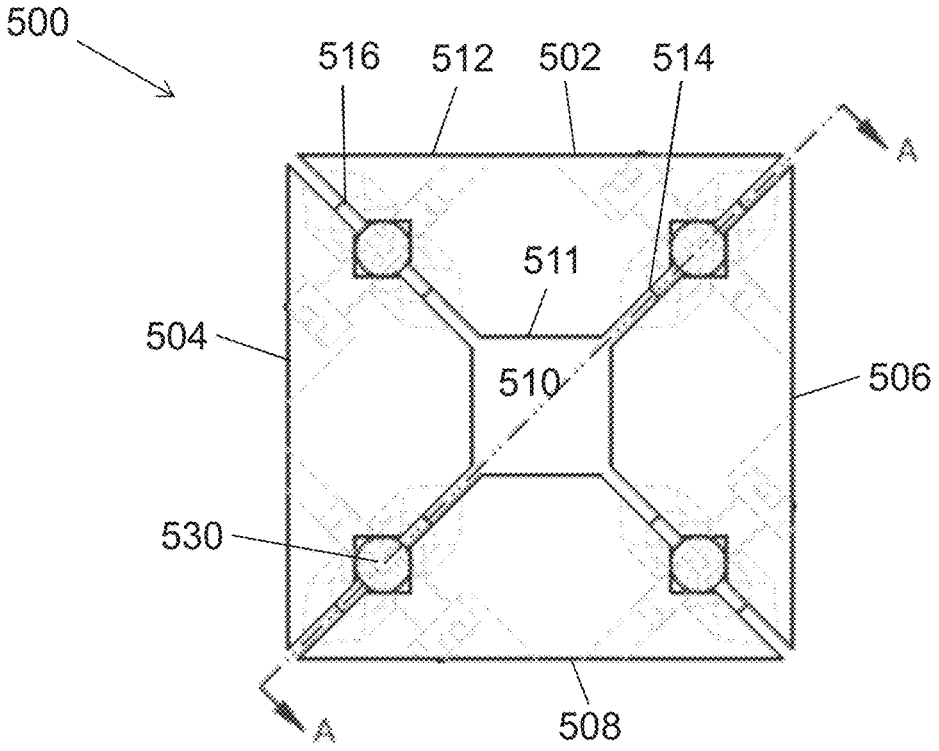
Figure 5D:
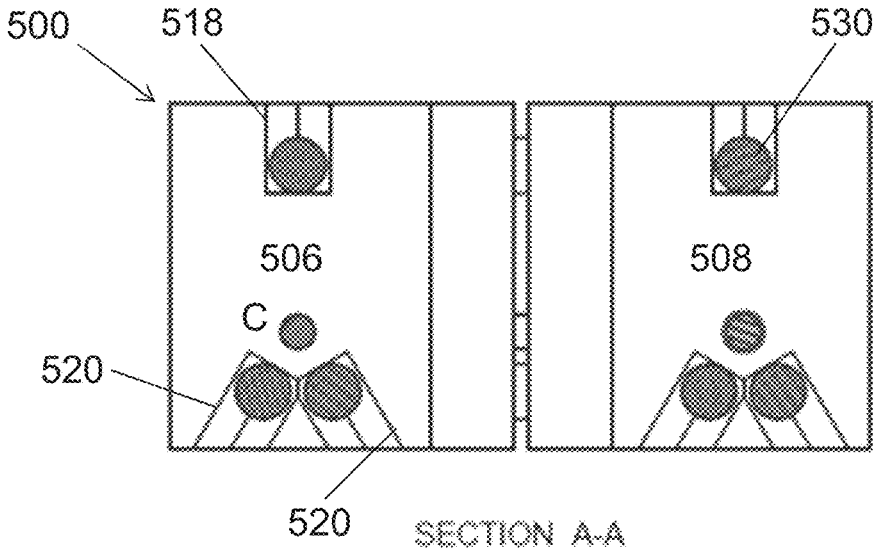

FIGS. 4A and 48 illustrate kinematic alignment. FIG. 4A shows a simple example, including two pieces 402, 404. Piece 402 has three arms 406, each having a sphere of material 408 located on the bottom surface of the arm 408. Upper surface 410 of piece 404 includes three V-shaped notches 412, each groove having two surfaces 414, 416 intersecting at approximately 45°. When piece 402 is lowered onto piece 404, the spheres 408 each sit in the respective V-shaped notches, so that each surface 414, 416 of each V-shaped notch 412 contacts the corresponding sphere 408 once only, giving rise to six points of contact, and therefore to a kinematic alignment. The surfaces of each V-shaped notch 412 preferably contacts its corresponding sphere 408 substantially tangentially.

FIG. 48 shows a slightly more complicated example of kinematic alignment, having pieces 402', 404'. Piece 402' has the same features as piece 402 in FIG. 4A. However, in FIG. 48, piece 404' has three notches 410*a*', 410*b*', 410*c*' which are different. Specifically, notch 410*a*' includes three surfaces 418', notch 410*b*' includes two surfaces 420', and notch 410*c*' includes just a flat surface 422'. When the piece 402' is lowered towards the piece 404', each of the spheres 408' engages with the notches 410*a*', 410*b*', 410*c*'. Once again, this gives rise to six points of contact, again leading to kinematic alignment, albeit differently from in FIG. 4A.

FIGS. 5A to 5D show an alternative embodiment of a quadrupole device that may be manufactured according to the method of the first aspect of the invention. In contrast to the embodiment shown in FIGS. 3A to 3D, the device 500 shown in FIGS. 5A to 5D is made of four separate electrodes 502, 504, 506, 508. Whereas the electrodes 304, 306, 308 in device 300 of FIGS. 3A to 3D had hyperbolic surfaces, the electrodes 502, 504, 506, 508 have flat surfaces, to form a channel 510 running between them, the channel 510 having a square cross-section.

The four electrodes 502, 504, 506, 508 are substantially identical, so only electrode 502 will be described here. To avoid crowding of the drawings, only this electrode 502 is labelled, but it is clear that the same description and labelling applies equally well for the remaining three electrodes 504, 506, 508.

Electrode 502 is a prism with a trapezoidal cross-section, having a front surface 511, a rear surface 512, and two oblique surfaces 514, 516. As best shown in FIG. 70, each of the oblique surfaces 514, 516 includes three V-shaped notches 518, 520, 522, each having two flat surfaces intersecting at approximately 45°. The centroid C is the location where the three invisible lines extending from and parallel to the V-groove meet. This is discussed in more depth shortly, with reference to fastening.

The electrode 502 includes two bores 524, 526. First bore 524 runs from the rear surface 512 to oblique surface 514. The rear surface end of bore 524 has a widened portion 528. Second bore 526 also runs from the rear surface 512 to oblique surface 516, and has a constant cross-section.

The electrodes 502, 504, 506, 508 are assembled, as shown, so that the notches 518, 520, 522 on the oblique surfaces 514, 516 of electrode 502 line up with corresponding notches on each of the adjacent electrodes 504, 506. The same applies for each of electrodes 504, 506, 508. An insulating ball 530 is located in each of the twelve spaces formed by the alignment of the notches on adjacent electrodes 502, 504, 506, 508. At each meeting of oblique surfaces in the device 500, the insulating ball contacts each of the electrodes six times, ensuring a kinematic alignment between the two contacting electrodes.

The first bore 524 of e.g. electrode 502 is arranged to align with the second bore 526 of adjacent electrode 506, and a fastener 532 is passed through the bores 524, 526 to secure the electrodes together. Similarly, the second bore 526 of electrode 502 is arranged to align with the first bore 524 of adjacent electrode 504, and they are joined by another fastener 532. The same applies for electrodes 504, 506 and 508.

The notches 518, 520, 522 are arranged on the oblique surfaces 514, 516 of e.g. electrode 502 so that the centroid C is located where the bores 524, 526 emerge. In this way, each of the insulating balls 530 receives approximately equal stress.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

All references referred to above are hereby incorporated by reference.

Aspects or examples of the invention may be defined according to the following numbered Paragraphs:

Paragraph 1: A method of manufacturing a multipole device, the method including the steps of:

(a) forming an intermediate device by assembling a plurality of components including a plurality of precursor multipole electrodes, wherein the plurality of precursor multipole electrodes in the assembled device extend along and are distributed around a central axis;

(b) forming a multipole device from the intermediate device by machining the precursor multipole electrodes within the intermediate device to provide a plurality of multipole electrodes having a predetermined spatial relationship;

wherein a first component of the multipole device that includes a multipole electrode is attached non-permanently to a second component of the multipole device, the first component including a first alignment formation, and the second component including a second alignment portion configured to engage with the first alignment formation on the first component so as to facilitate alignment of the first component and the second component when the first component and the second component are attached, thereby allowing the first component to be detached from and then reattached to the second component while retaining the predetermined spatial relationship between the plurality of multipole electrodes.

Paragraph 2: A method according to Paragraph 1, wherein in step (b) the machining is in the form of wire electrical discharge machining.

Paragraph 3: A method according to Paragraph 1 or Paragraph 2, further including the steps of:

(c) disassembling the plurality of multipole electrodes;

(d) performing at least one processing step on the plurality of multipole electrodes, the at least one processing step including one or more of:

cleaning the plurality of multiple electrodes, polishing surfaces of the plurality of multiple electrodes, and plating of the plurality of multiple electrodes; and (e) reassembling the plurality of multipole electrodes to reform the multipole device, in which the plurality of multipole electrodes have the same predetermined spatial relationship.

Paragraph 4: A method according to any one of Paragraphs 1 to 3, wherein the position of any point on a surface of the second component is substantially the same before and after detachment and reattachment of the first component and the second component, relative to a coordinate system which is fixed with respect to the first component.

Paragraph 5: A method according to any one of Paragraphs 1 to 4, wherein the first alignment formation and the second alignment formation together form at least part of a kinematic alignment formation arranged to constrain the motion of the first component relative to the second component once in each degree of freedom.

Paragraph 6: A method according to Paragraph 5, wherein the first alignment formation is arranged to contact the second alignment formation in only six locations, when the first component is attached to the second component.

Paragraph 7: A method according to any one of Paragraphs 1 to 6, wherein the first alignment formation includes a notch, having two flat surfaces.

Paragraph 8: A method according to Paragraph 7, wherein the second alignment formation includes a spherical or spheroidal structure.

Paragraph 9: A method according to Paragraph 8, wherein the first alignment formation includes three notches, and the second alignment formation includes three spherical or spheroidal structures, wherein each of the notches is arranged to engage with a respective one of the spherical or spheroidal structures when the first component and the second component are attached.

Paragraph 10: A method according to any one of Paragraphs 1 to 5, wherein the first alignment formation is configured to engage indirectly with the second alignment formation via one or more intermediary components, such that both the first alignment formation and the second alignment formation are in contact with the intermediary component.

Paragraph 11: A method according to Paragraph 10, wherein when the first component is attached to the second component, each of the first alignment formation and the second alignment formation contact the one or more intermediary components in only six locations.

Paragraph 12: A method according to Paragraph 11, wherein the intermediary components are in the form of spherical or spheroidal structures made from an electrically insulating material.

Paragraph 13: A method according to any one of Paragraphs 1 to 12, wherein the plurality of components include a main body including two or more integrally formed poles, and two or more other poles configured to be situated within the main body.

Paragraph 14: A method according to any one of Paragraphs 1 to 13, wherein the quadrupole device is one of: a quadrupole ion guide, a segmented quadrupole ion guide, a quadrupole mass filter, a segmented quadrupole mass filter, a linear ion trap, or a segmented linear ion trap.

Paragraph 15: A multipole device, including:

a plurality of components including a plurality of multipole electrodes extending along and distributed around a central axis, the plurality of multipole electrodes having a predetermined spatial relationship;

wherein a first component of the multipole device that includes a multipole electrode is attached non-permanently to a second component of the multipole device, the first component including a first alignment formation, and the second component including a second alignment portion configured to engage with the first alignment formation on the first component so as to facilitate alignment of the first component and the second component when the first component and the second component are attached, thereby allowing the first component to be detached from and then reattached to the second component while retaining the predetermined spatial relationship between the plurality of multipole electrodes.

The invention claimed is:

1. A method of manufacturing a multipole device, the method including the steps of:

(a) forming an intermediate device by assembling a plurality of components including a plurality of precursor multipole electrodes, wherein the precursor electrodes each comprise a prism with a trapezoidal cross-section having a rear surface, two oblique surfaces and a front surface which is flat such that the four precursor electrodes form a channel running between them, the channel having a square cross-section, wherein the plurality of precursor multipole electrodes in the assembled device extend along and are distributed around a central axis wherein a first component of the intermediate device includes a first alignment formation and a second component of the intermediate device includes a second alignment formation, the method including positioning the first component of the intermediate device and second component of the intermediate device by using the first and second alignment formations so that the first component of the intermediate device can be detached from and then reattached to the second component of the intermediate device while retaining a predetermined spatial relationship within the intermediate device;

(b) forming a multipole device from the intermediate device by machining the precursor multipole electrodes within the intermediate device to provide a plurality of multipole electrodes having said predetermined spatial relationship;

wherein a first component of the multipole device that includes a multipole electrode is attached non-permanently to a second component of the multipole device that includes a multipole electrode, the first component of the multipole device including said first alignment formation on a said oblique surface of a first electrode of the precursor multipole electrodes, and the second component of the multipole device including said second alignment formation on a said oblique surface of a second electrode of the precursor multipole electrodes configured to engage with the first alignment formation so as to facilitate alignment of the first component of the multipole device and the second component of the multipole device when the first component of the multipole device and the second component of the multipole device are attached, thereby allowing the first component of the multipole device to be detached from and then reattached to the second component of the multipole device while retaining the predetermined spatial relationship between the plurality of multipole electrodes.

2. A method according to claim 1, wherein in step (b) the machining is in the form of wire electrical discharge machining.

3. A method according to claim 1, further including the steps of:

(c) disassembling the plurality of multipole electrodes;

(d) performing at least one processing step on the plurality of multipole electrodes, the at least one processing step including one or more of:

cleaning the plurality of multiple electrodes, polishing surfaces of the plurality of multiple electrodes, and plating of the plurality of multiple electrodes; and (e) reassembling the plurality of multipole electrodes to reform the multipole device, in which the plurality of multipole electrodes have the same predetermined spatial relationship.

4. A method according to claim 1, wherein the position of any point on a surface of the second component is substantially the same before and after detachment and reattachment of the first component and the second component, relative to a coordinate system which is fixed with respect to the first component.

5. A method according to claim 1, wherein the first alignment formation and the second alignment formation together form at least part of a kinematic alignment formation arranged to constrain the motion of the first component relative to the second component once in each degree of freedom.

6. A method according to claim 5, wherein the first alignment formation is arranged to contact the second alignment formation in only six locations, when the first component is attached to the second component.

7. A method according to claim 1, wherein the first alignment formation includes a notch, having two flat surfaces.

8. A method according to claim 7, wherein the second alignment formation includes a spherical or spheroidal structure.

9. A method according to claim 8, wherein the first alignment formation includes three notches, and the second alignment formation includes three spherical or spheroidal structures, wherein each of the notches is arranged to engage with a respective one of the spherical or spheroidal structures when the first component and the second component are attached.

10. A method according to claim 1, wherein the first alignment formation is configured to engage indirectly with the second alignment formation via one or more intermediary components, such that both the first alignment formation and the second alignment formation are in contact with the intermediary component.

11. A method according to claim 10, wherein when the first component is attached to the second component, each of the first alignment formation and the second alignment formation contact the one or more intermediary components in only six locations.

12. A method according to claim 11, wherein the intermediary components are in the form of spherical or spheroidal structures made from an electrically insulating material.

13. A method according to claim 1, wherein the plurality of components include a main body including two or more integrally formed poles, and two or more other poles configured to be situated within the main body.

14. A method according to claim 1, wherein the quadrupole device is one of: a quadrupole ion guide, a segmented quadrupole ion guide, a quadrupole mass filter, a segmented quadrupole mass filter, a linear ion trap, or a segmented linear ion trap.

15. A multipole device, including:

a plurality of components including a plurality of multipole electrodes extending along and distributed around a central axis, the plurality of multipole electrodes having a predetermined spatial relationship;

wherein a first component of the multipole device that includes a multipole electrode is attached non-permanently to a second component of the multipole device that includes a multipole electrode, the first component including a first alignment formation, and the second component including a second alignment formation configured to engage with the first alignment formation on the first component so as to facilitate alignment of the first component and the second component when the first component to be detached from and then reattached to the second component while retaining the predetermined spatial relationship between the plurality of multipole electrodes;

wherein the first component of the multipole device and the second component of the multipole device are machined components formed by providing an intermediate device comprising an assembly of a plurality of components including a plurality of precursor multipole electrodes including a first component of an intermediate device including said first alignment formation and a second component of the intermediate device including said second alignment formation, positioning the first component of the intermediate device and second component of the intermediate device by using the first and second alignment formations so that the first component of the intermediate device can be detached from and then reattached to the second component of the intermediate device while retaining a predetermined spatial relationship within the intermediate device, and matching the precursor multipole electrodes within the intermediate device to provide a plurality of multipole electrodes having said predetermined spatial relationship, wherein the precursor electrodes each comprise a prism with a trapezoidal cross-section; wherein the first alignment formation is on a said oblique surface of a first electrode of the plurality of precursor electrodes, and the second alignment formation is on a said oblique surface of a second electrode of the plurality of precursor electrodes.

* * * * *